US011443665B2

(12) United States Patent
Chen

(10) Patent No.: US 11,443,665 B2
(45) Date of Patent: Sep. 13, 2022

(54) PROTECTION SYSTEM FOR GOA CIRCUIT AND LIQUID CRYSTAL DISPLAY PANEL

(71) Applicant: Shenzhen China Star Optoelectronics Semiconductor Display Technology Co., Ltd., Guangdong (CN)

(72) Inventor: Shujhih Chen, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/254,902

(22) PCT Filed: Apr. 29, 2020

(86) PCT No.: PCT/CN2020/087748
§ 371 (c)(1),
(2) Date: Dec. 22, 2020

(87) PCT Pub. No.: WO2021/196330
PCT Pub. Date: Oct. 7, 2021

(65) Prior Publication Data

US 2022/0051595 A1 Feb. 17, 2022

(30) Foreign Application Priority Data

Apr. 3, 2020 (CN) ..... 202010257397.8

(51) Int. Cl.
*G09G 3/00* (2006.01)
*G09G 3/20* (2006.01)
*G09G 3/36* (2006.01)

(52) U.S. Cl.
CPC ..... *G09G 3/006* (2013.01); *G09G 3/2092* (2013.01); *G09G 3/3677* (2013.01)

(58) Field of Classification Search
None
See application file for complete search history.

(56) References Cited

U.S. PATENT DOCUMENTS

2010/0238143 A1* 9/2010 Liu ..... G09G 3/20 345/204
2016/0247430 A1 8/2016 Cho et al.
2017/0017326 A1 1/2017 Wu et al.
2017/0256216 A1 9/2017 Cao
2018/0151142 A1* 5/2018 Tian ..... G02F 1/136286
2018/0211629 A1* 7/2018 Zeng ..... G09G 3/36
2018/0357946 A1 12/2018 Ryu et al.

FOREIGN PATENT DOCUMENTS

CN 104092448 10/2014
CN 104700811 6/2015
CN 104700811 A * 6/2015
(Continued)

*Primary Examiner* — Kirk W Hermann

(57) ABSTRACT

A switching circuit is signally-connected to an initial trigger signal, a detection circuit and the GOA circuit. Upon a low voltage level of a low potential signal, the switching circuit is turned on to transmit the initial trigger signal to the GOA circuit so that the LCD panel works normally. Upon a high voltage level of the low potential signal, the switching circuit is turned off so that the GOA circuit does not conduct the initial trigger signal to protect the LCD panel from burn-out.

20 Claims, 5 Drawing Sheets

(56) References Cited

FOREIGN PATENT DOCUMENTS

| | | | | | |
|---|---|---|---|---|---|
| CN | 105096876 | | | 11/2015 | |
| CN | 105304050 | | | 2/2016 | |
| CN | 106169289 | | | 11/2016 | |
| CN | 106297702 | | | 1/2017 | |
| CN | 105304050 | B | * | 7/2017 | |
| CN | 105448260 | B | * | 11/2017 | |
| CN | 108303581 | | | 7/2018 | |
| CN | 106297702 | B | * | 11/2018 | ..... G09G 3/36 |
| KR | 2016-0103615 | | | 9/2016 | |

* cited by examiner

PROTECTION SYSTEM FOR GOA CIRCUIT AND LIQUID CRYSTAL DISPLAY PANEL

RELATED APPLICATIONS

This application is a National Phase of PCT Patent Application No. PCT/CN2020/087748 having International filing date of Apr. 29, 2020, which claims the benefit of priority of Chinese Patent Application No. 202010257397.8 filed on Apr. 3, 2020. The contents of the above applications are all incorporated by reference as if fully set forth herein in their entirety.

FIELD AND BACKGROUND OF THE INVENTION

The present invention relates to the technical field of display, a protection system for GOA circuit and a liquid crystal display panel in particular.

Traditional liquid crystal display (LCD) devices include source drivers, gate drivers and an LCD panel, and the gate drivers are disposed outside the LCD panel. In prior art, the gate drivers have been disposed on the LCD panel, that is, the gate driver on array (GOA) technique. The GOA technique makes use of existing thin film transistor LCD panel array fabrication processes to fabricate the driving signal circuit of the gate scan line on the array substrate to realize progressive scanning of the gate. When a clock signal and an initial trigger signal STV, generated by the control panel, are transmitted to the GOA unit, the GOA unit will generate a scan signal to the pixel unit in the pixel array area, and the source driver will output the grayscale voltage to the pixel unit in the pixel array area at the same time to make the LCD panel display normally.

As shown in FIG. 1, the GOA circuit is a cascade of GOA units, when the first stage GOA unit 101 receives the initial trigger signal STV, the first stage GOA unit outputs the first row scan signal G001, the first row scan signal G001 passes through the signal line 1012, and serves as the cascade signal of the second stage GOA unit 102. The second stage GOA unit 102 outputs the second row scan signal G001 which serves as a pull-up signal, the pull-up signal passes through the signal line 1011 to transmit in the first stage GOA unit 101 for correcting the waveform of the first row scan signal G001. The cascade signals of other GOA units are transmitted the same as the above description to realize that the GOA circuit outputs the scan signals of the entire LCD panel. Since pre-stage GOA units and post-stage GOA units in the GOA circuit influence each other, the scan signal output by the next stage GOA unit will be influenced if any one of the GOA units are broken.

Therefore, technical problems exist in the prior art, wherein if even one short circuit occurs between a low potential signal VSSQ/VSSG and a high-voltage signal, it will cause a massive surge in electric flow and can affect the normal operation of the entire GOA circuit, leading to an abnormal display, and can even cause the display panel to burn out. This problem needs to be solved.

SUMMARY OF THE INVENTION

The present application provides a protection system and a liquid crystal display panel for GOA circuit which can solve the technical problems, exist in the prior art, about the large current, abnormal operation of the whole GOA circuit, display abnormally and LCD panel burn-out caused by the low potential signal VSSQ/VSSG short-circuited with the high-potential signal in any one of the GOA units of multiple cascade GOA units in the GOA circuit of the LCD panel.

In order to solve above problems, the technical solutions provided by the present application are as follows:

An embodiment of the present application provides a protection system for a gate on array (GOA) circuit. The protection system includes a detection circuit which is connected to the GOA circuit, and is configured to generate a driving signal in response to a low potential signal of the GOA circuit; and a switching circuit which is signally-connected to an initial trigger signal, the detection circuit and the GOA circuit, the switching circuit is configured to transmit the initial trigger signal to the GOA circuit according to the driving signal.

Wherein, upon a low voltage level of the low potential signal, the switching circuit is turned on to conduct the initial trigger signal to the GOA circuit, and upon a high voltage level of the low potential signal, the switching circuit is turned off so that the GOA circuit does not conduct the initial trigger signal.

A preferred embodiment according to the present application, the detection circuit includes a first comparator and an inverter, the low potential signal includes a first low potential signal; an input terminal of the first comparator is signally-connected to the first low potential signal; an output terminal of the first comparator is connected to an input terminal of the inverter; an output terminal of the inverter is connected to a control terminal of the switching circuit.

A preferred embodiment according to the present application, the low potential signal further includes a second low potential signal; the detection circuit further includes a second comparator; an input terminal of the second comparator is signally-connected to the second low potential signal; both of an output terminal of the second comparator and an output terminal of the first comparator are connected to an input terminal of the inverter.

A preferred embodiment according to the present application, the switching circuit includes a switching thin film transistor (TFT); a drain of the switching TFT is signally-connected to the initial trigger signal; a source of the switching TFT is connected to the GOA circuit; a gate of the switching TFT is signally-connected to the driving signal.

A preferred embodiment according to the present application, the first comparator includes a first TFT, a second TFT, a third TFT, and a fourth TFT, arranged in a first row; a fifth TFT, a sixth TFT, a seventh TFT and an eighth TFT, arranged in a second row; wherein sources of the first TFT, the second TFT, the third TFT, and the fourth TFT are electrically connected to 28V voltage to form a high potential circuit loop, drains of the fifth TFT, the sixth TFT, the seventh TFT and the eighth TFT are electrically connected to 0V voltage to form a low potential circuit loop.

A preferred embodiment according to the present application, the inverter includes a ninth TFT, a tenth TFT, an eleventh TFT and a twelfth TFT; wherein a gate of the ninth TFT and a gate of the twelfth TFT are electrically connected to the output terminals of the first comparator and the second comparator, a drain of the ninth TFT is electrically connected to a drain of the twelfth TFT, and is electrically connected to −10V voltage to form a low potential circuit loop; a source of the ninth TFT is electrically connected to a source of the eleventh TFT, and the source of the ninth TFT is electrically connected to a drain of the tenth TFT, a gate of the tenth TFT, a source of the tenth TFT and the source of the eleventh TFT are electrically connected to each other and 28V voltage to form a high potential circuit loop.

A preferred embodiment according to the present application, a structure and a function of the first comparator and the second comparator are identical and are used for inputting different low voltage signals of the GOA unit, if one of the output terminal of the first comparator and the second comparator outputs a high potential voltage, the inverter outputs a low potential voltage.

A preferred embodiment according to the present application, the switching TFT is N-type TFT.

A preferred embodiment according to the present application, the first TFT to the eighth TFT are N-type TFTs.

A preferred embodiment according to the present application, the eighth TFT to the twelfth TFT are N-type TFTs.

According to the above protection system of the GOA circuit, the present application further provides a liquid crystal display (LCD) panel which includes the protection system of the GOA circuit in the embodiments described above, the protection system of the GOA circuit includes the detection circuit connected to the GOA circuit, and configured to generate the driving signal in response to the low potential signal of the GOA circuit; and the switching circuit signally-connected to the initial trigger signal, the detection circuit and the GOA circuit, the switching circuit configured to transmit the initial trigger signal to the GOA circuit according to the driving signal; wherein upon the low voltage level of the low potential signal, the switching circuit is turned on to conduct the initial trigger signal to the GOA circuit; and upon the high voltage level of the low potential signal, the switching circuit is turned off so that the GOA circuit does not conduct the initial trigger signal, the GOA circuit includes a plurality of stages of GOA units, except for the last stage of the GOA units, the output scan signal of each stage of the GOA units serves as a cascade signal of the next stage of the GOA units; except for the first stage of the GOA units, the output scan signal of each stage of the GOA units and a pull-down signal of a previous stage of the GOA units of the stage of the GOA unit, the pull-down signal is used to correct a waveform of the scan signal at the previous stage of the GOA units.

A preferred embodiment according to the present application, the detection circuit includes the first comparator and the inverter; the low potential signal includes the first low potential signal; the input terminal of the first comparator is signally-connected to the first low potential signal; the output terminal of the first comparator is connected to the input terminal of the inverter; the output terminal of the inverter is connected to the control terminal of the switching circuit.

A preferred embodiment according to the present application, the low potential signal further includes a second low potential signal; the detection circuit further includes the second comparator; the input terminal of the second comparator is signally-connected to the second low potential signal; both of the output terminal of the second comparator and the output terminal of the first comparator are connected to the input terminal of the inverter.

A preferred embodiment according to the present application, the switching circuit includes a switching thin film transistor (TFT); the drain of the switching TFT is signally-connected to the initial trigger signal; the source of the switching TFT is connected to the GOA circuit; the gate of the switching TFT is signally-connected to the driving signal.

A preferred embodiment according to the present application, the first comparator includes a first TFT, a second TFT, a third TFT, a fourth TFT, arranged in a first row; a fifth TFT, a sixth TFT, a seventh TFT and an eighth TFT, arranged in a second row; wherein sources of the first TFT, the second TFT, the third TFT and the fourth TFT are electrically connected to 28V voltage to form a high potential circuit loop; drains of the fifth TFT, the sixth TFT, the seventh TFT and the eighth TFTs are electrically connected to 0V voltage to form a low potential circuit loop.

A preferred embodiment according to the present application, the inverter includes a ninth TFT, a tenth TFT, an eleventh TFT, a twelfth TFT; wherein a gate of the ninth TFT and a gate of the twelfth TFT are electrically connected to the output terminals of the first comparator and the second comparator, a drain of the ninth TFT is electrically connected to a drain of the twelfth TFT, and is electrically connected to −10V voltage to form a low potential circuit loop; a drain of the ninth TFT is electrically connected to a drain of the eleventh TFT, and a source of the ninth TFT is electrically connected to a drain of the tenth TFT, a gate of the tenth TFT, a source of the tenth TFT and a source of the eleventh TFT are electrically connected to each other and 28V voltage to form a high potential circuit loop.

A preferred embodiment according to the present application, a structure and a function of the first comparator and the second comparator are identical and are used for inputting different low voltage signals of the GOA unit, if one of the output terminal of the first comparator and the second comparator outputs a high potential voltage, the inverter outputs a low potential voltage.

A preferred embodiment according to the present application, the switching TFT is N-type TFT.

A preferred embodiment according to the present application, the first TFT to the eighth TFT are N-type TFTs.

A preferred embodiment according to the present application, the eighth TFT to the twelfth TFT are N-type TFTs.

The present application provides a protection system and a liquid crystal display panel for GOA circuit, the protection system of the GOA circuit of the present application

BRIEF DESCRIPTION OF THE SEVERAL VIEWS OF THE DRAWINGS

In order to illustrate the embodiments or the technical solutions in the prior art more clearly, the drawings used in the embodiments or the prior art description will be briefly introduced below. Obviously, the drawings in the following description are only for some embodiments of the invention, and those skilled in the art can obtain other drawings according to the drawings without any creative work.

DETAILED DESCRIPTION OF SPECIFIC EMBODIMENTS OF THE INVENTION

The following description of the various embodiments is provided with reference to the accompanying drawings.

Directional terms, such as upper, lower, front, back, left, right, inner, outer, and lateral side, mentioned in the present invention are only for reference. Therefore, the directional terms are used for describing and understanding rather than limiting the present invention. In the figures, units having similar structures are used for the same reference numbers.

The present application focuses on technical problems existing in the prior art, regarding large current, abnormal operation of the whole GOA circuit, and abnormal display and LCD panel burn-out caused by a short circuit between a low potential signal VSSQ/VSSG with a high-potential signal in any one of the GOA units of multiple cascade GOA units in the GOA circuit of the LCD panel. This embodiment provides a solution to these defects.

Figure 1:
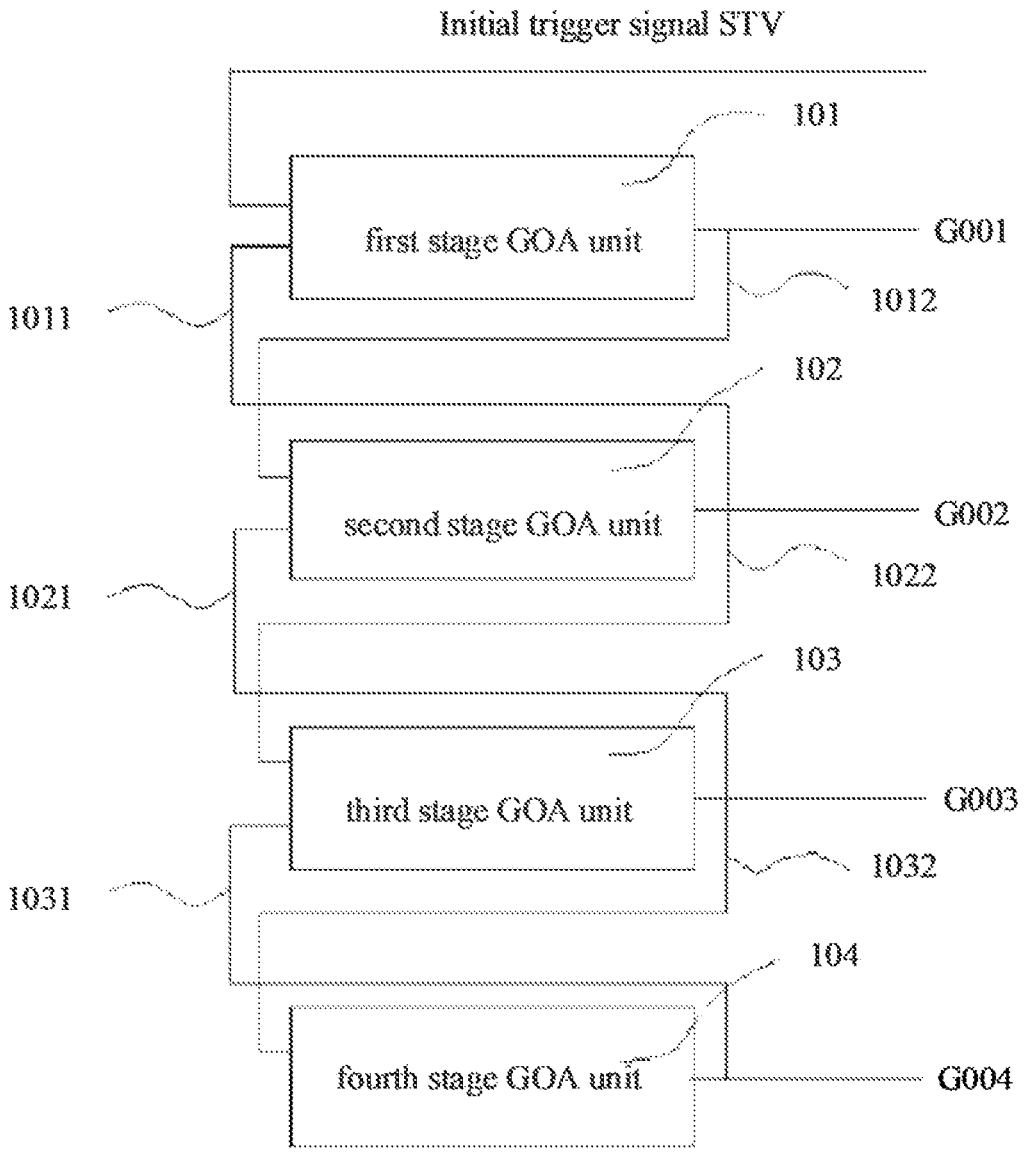
FIG. 1 (Prior art)
FIG. 1 is a structural schematic view of a GOA circuit in the prior art.
Figure 2:
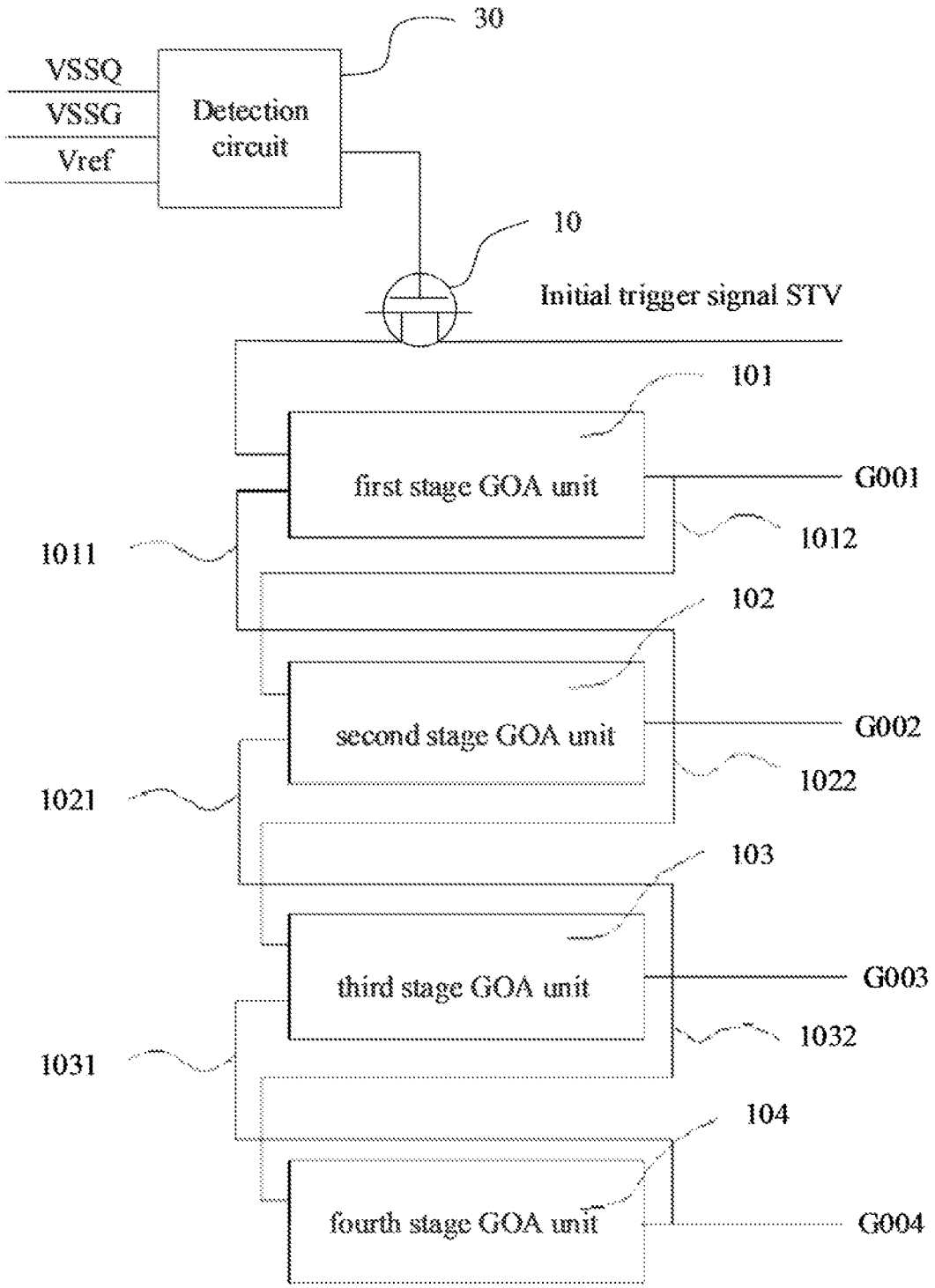
FIG. 2 is a schematic view of a protection system for the GOA circuit according to the embodiment of the present invention.

As shown in FIG. 2, the embodiment of the present application provides a protection system for a GOA circuit. The protection system includes a detection circuit 30 which is connected to the GOA circuit, and is configured to generate a driving signal in response to the low potential signal (VSSQ/VSSG) of the GOA circuit; and a switching circuit 10 which is configured to transmit an initial trigger signal STV, and is connected to the detection circuit 30 and the GOA circuit, the switching circuit 10 is configured to transmit the initial trigger signal STV to the GOA circuit according to the driving signal. Wherein, upon a low voltage level of the low potential signal, the switching circuit 10 is turned on to transmit the initial trigger signal STV to the GOA circuit, and upon a high voltage level of the low potential signal, the switching circuit 10 is turned off so that the GOA circuit does not receive the initial trigger signal STV. In this embodiment, the switching circuit 10 is preferably an N-type switching thin film transistor (TFT). A drain of the switching TFT signally-connects to the initial trigger signal STV; a source of the switching TFT is connected to the GOA circuit; a gate of the switching TFT signally-connects to the driving signal. If the driving signal is a high potential voltage signal, the switching circuit is turned on to conduct the initial trigger signal STV to the GOA circuit. If the driving signal is a low potential voltage signal, the switching circuit is turned off so that the GOA unit does not transmit the initial trigger signal STV.

In this embodiment, the GOA circuit includes a plurality of stages of GOA units, except for the last stage of the GOA units, an output scan signal of each stage of the GOA units serves as a cascade signal of the next stage of the GOA units; except for the last stage of the GOA units, the output scan signal of each stage of the GOA units serves as a pull-down signal of the previous stage of the GOA units of the stage of the GOA unit, the pull-down signal is used to correct the waveform of the scan signal at the previous stage of the GOA units. For example, a first stage GOA unit 101 outputs a scan signal G001, the scan signal G001 is transmitted to a second stage GOA unit 102, and serves as a cascade signal of the second stage GOA unit 102 through a signal line 1012. The second stage GOA unit 102 outputs a scan signal G002 which serves as a pull-up signal of the first stage GOA unit 101, the pull-up signal is transmitted to the first stage GOA unit 101 through a signal line 1011. The cascade signals of other GOA units are transmitted same as described above to make the GOA circuit operate normally, and thus will not be further described.

Figure 3:
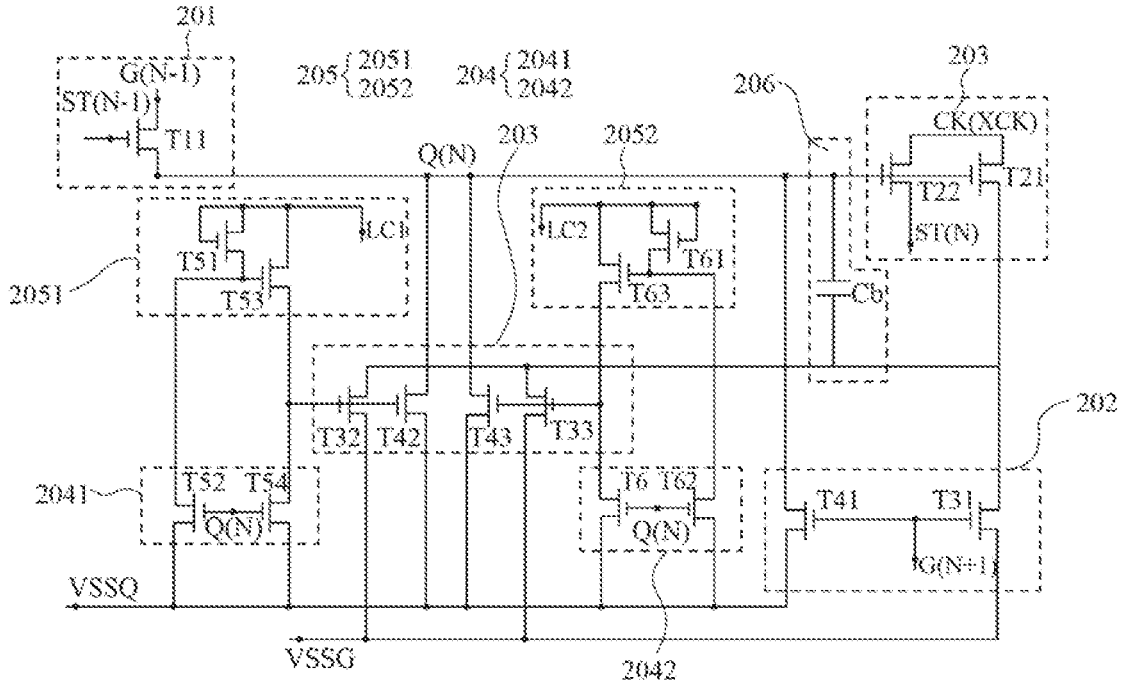
FIG. 3 is a schematic view of the GOA units in the GOA circuit according to the embodiment of the present invention.

As shown in FIG. 3, each stage of the GOA units includes a control module 201, a pull-up module 202, a downlink module 203, a pull-down module 204, a pull-down holding module 205, and a bootstrap module 206. The control module is configured to raise a potential of a first node (Q(N)) according to a stage-by-stage transmission signal (ST(N−1)) of an $(N-1)^{th}$ stage GOA unit and a scan signal (G(N−1)) of the $(N-1)^{th}$ stage GOA unit, which are conducted to the control module. The pull-up module 202 is electrically connected to the first node (Q(N)) and is configured to output a scan signal (G(N+1)) based on a clock signal (CK) or an inverse clock signal (XCK) that are conducted to the pull-up module 202 under control of the first node (Q(N)). The downlink module 203 is electrically connected to the first node (Q(N)), is signally-connected to clock signal (CK) or the inverse clock signal (XCK), and is configured to output the stage-by-stage transmission signal (ST(N)) based on the clock signal (CK) or the inverse clock signal (XCK) under the control of the first node (Q(N)). The stage-by-stage transmission signal (ST(N)) is the initial trigger signal STV of each stage of the GOA units. The scan signal (G(N)), the stage-by-stage transmission signal (ST(N+1)) of the $(N+1)^{th}$ stage GOA unit, the pull-down stage-by-stage transmission signal (STA) and a direct current low potential (VSS) are connected to the pull-down module 204, which is electrically connected to the first node (Q(N)), and is configured to pull down the potential of the first node (Q(N)) and the scan signal (G(N)) based on the direct current low potential (VSS) under the control of the stage-by-stage transmission signal (ST(N+1)) of the $(N+1)^{th}$ stage GOA unit and the pull-down stage-by-stage transmission signal (STA). The pull-down holding module 205 is electrically connected to the first node (Q(N)) and conducts the scan signal (G(N)) and the direct current low potential (VSS), and is configured to hold the potential of the first node (Q(N)) and the scan signal (G(N)) at a low potential signal (VSSQ/VSSG) and to output a pull-up signal LC. In the present embodiment, the pull-down holding module 205 includes a first pull-down holding module 2051 and the second pull-down holding module 2052, the first pull-down holding module 2051 outputs the first pull-up signal LC1, and the second pull-down holding module 2052 outputs the second pull-up signal LC2. The bootstrap module 206 is electrically connected to the first node (Q(N)) and conducts the scan signal (G(N)), and is configured to raise the potential of the first node (Q(N)) and holds the raised potential.

Figure 4:
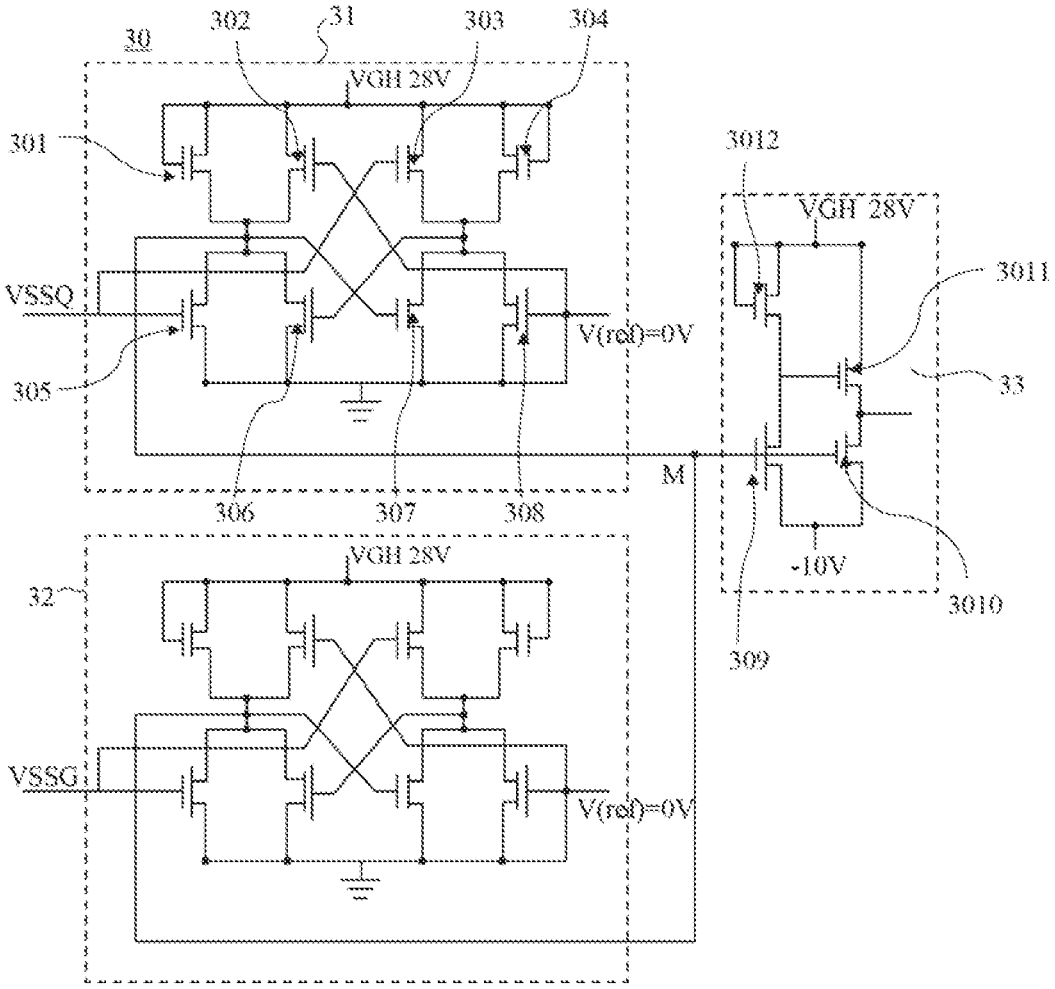
FIG. 4 is a schematic view of a detection circuit in the protection system of the GOA circuit according to the embodiment of the present invention.
Figure 5:
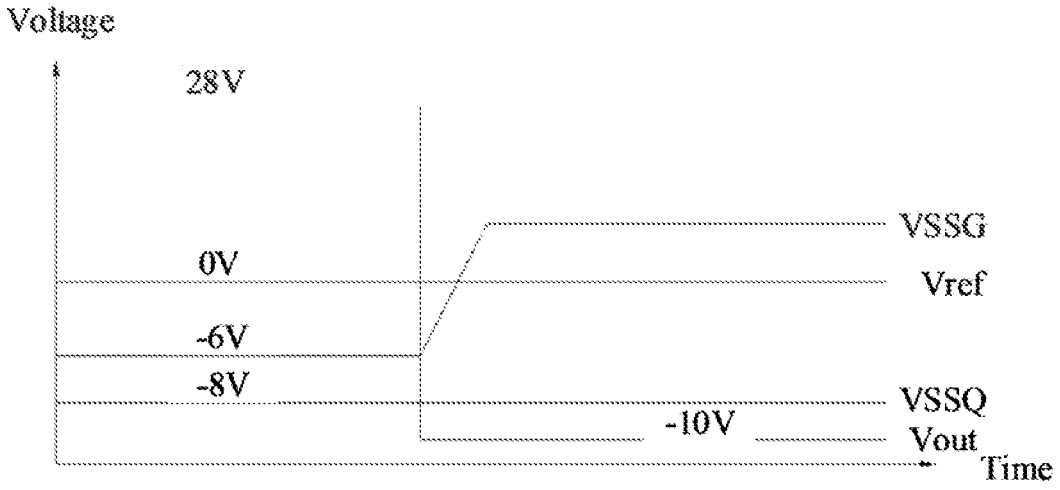
FIG. 5 is a schematic view of a short-circuited voltage in the protection system of the GOA circuit according to the embodiment of the present invention.

As shown in FIG. 4 and FIG. 5, the detection circuit 30 includes a first comparator 31 and an inverter 33, a low potential signal includes a first low potential signal VSSQ and the second low potential signal VSSG. An input terminal of the first comparator 31 is signally-connected to the first low potential signal VSSQ in the corresponding GOA unit. An output terminal of the first comparator 31 is connected to an input terminal of the inverter 33, i.e., the node M. An output terminal of the inverter 33 is connected to a control terminal of the switching circuit 10. The detection circuit 30 further includes a second comparator 32, wherein a structure and a function of the first comparator 31 and the second comparator 32 are identical and are used for inputting different low voltage signals of the GOA units. An input terminal of the second comparator 32 is signally-connected to the second low potential signal VSSG, both output terminals of the second comparator 32 and the first comparator 31 are connected to the input terminal of the inverter 33. If either one of the output terminals of the first comparator 31 and the second comparator 32 outputs a high potential voltage, the inverter 33 outputs a low potential voltage so that the initial trigger signal STV cannot be conducted to a first stage of the GOA units in the GOA circuit, and the LCD panel is protected from screen burn-out.

The first comparator includes a first TFT 301, a second TFT 302, a third TFT 303, a fourth TFT 304, a fifth TFT 305, a sixth TFT 306, a seventh TFT 307, and an eighth TFT 308. The first TFT 301, the second TFT 302, the third TFT 303, and the fourth TFT 304 are arranged in a first row, and sources of the first TFT 301, the second TFT 302, the third TFT 303, and the fourth TFT 304 are electrically connected to a 28V voltage to form a high potential circuit loop. The fifth TFT 305, the sixth TFT 306, the seventh TFT 307, and the eighth TFT 308 are arranged in a second row, and drains of the fifth TFT 305, the sixth TFT 306, the seventh TFT 307, and the eighth TFT 308 are electrically connected to a 0V voltage to form a low potential circuit loop. In the present embodiment, the first low potential signal VSSQ is −8V, the second low potential signal VSSG is −6V. After a period of time, the second low potential signal VSSG changes from −6V to a high voltage which is between 0V and 28V, as shown in FIG. 5.

The converter 33 includes a ninth TFT 309, a tenth TFT 3010, an eleventh TFT 3011, and a twelfth TFT 3012. The gate of the ninth TFT 309 and the gate of the twelfth TFT 3012 are electrically connected to the output terminal of the first comparator 31 and the output terminal of the second comparator 32. The drain of the ninth TFT 309 is electrically connected to the drain of the twelfth TFT 3012 and is electrically connected to −10V voltage to form the low potential circuit loop. A source of the ninth TFT 309 is electrically connected to a source of the eleventh TFT 3011, and the source of the ninth TFT 309 is electrically connected to a drain of the tenth TFT 3010, the gate of the tenth TFT 3010, the source of the tenth TFT 3010 and the source of the eleventh TFT 3011 are electrically connected to each other and 28V voltage to form the high potential circuit loop. In this embodiment, the first to the twelfth TFTs are N-type TFTs. The first low potential signal VSSQ is −8V, the second low potential signal VSSG is −6V, the converter 33 outputs 28V, and the switching circuit 10 is turned on so that the GOA circuit works normally. The first low potential signal VSSQ is −8V, when the GOA circuit experiences a short circuit, the voltage of the second low potential signal VSSG will rise above 0V, the converter 33 outputs −10V, the switching circuit 10 is turned off so that the first stage GOA unit 101 in the GOA circuit does not conduct the initial trigger signal STV, and the GOA circuit stops working, and the LCD panel is protected from burn-out, as shown in FIG. 5.

According to above GOA circuit, the present application further provides an LCD panel which includes the GOA circuit described above.

The present application provides the protection system for the GOA circuit and the LCD panel. The protection system for the GOA circuit of the present application includes the detection circuit which is connected to the GOA circuit, and is configured to generate the driving signal in response to the low potential signal of the GOA circuit; and the switching circuit which is signally-connected to the initial trigger signal, the detection circuit and the GOA circuit, the switching circuit is configured to transmit the initial trigger signal to the GOA circuit according to the driving signal. Upon the low voltage level of the low potential signal, the switching circuit is turned on to conduct the initial trigger signal to the GOA circuit, and upon the high voltage level of the low potential signal, the switching circuit is turned off so that the GOA circuit does not conduct the initial trigger signal, and the GOA circuit stops working to protect the LCD panel from burn-out.

The above disclosures are the preferred embodiments of the present invention. However, these embodiments are not intended to limit the present invention. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims.

What is claimed is:

1. A protection system for a gate on array (GOA) circuit, comprising:

a detection circuit means, connected to the GOA circuit, and configured to generate a driving signal in response to a low potential signal of the GOA circuit; and a switching circuit signally-connected to an initial trigger signal, and connected to the detection circuit means, and the GOA circuit, and is configured to transmit the initial trigger signal to the GOA circuit according to the driving signal;

wherein upon a low voltage level of the low potential signal, the switching circuit is turned on to transmit the initial trigger signal to the GOA circuit, and upon a high voltage level of the low potential signal, the switching circuit is turned off so that the GOA circuit does not receive the initial trigger signal.

2. The protection system for the GOA circuit as claimed in claim 1, wherein the detection circuit means comprises a first comparator and an inverter; the low potential signal comprises a first low potential signal; and an input terminal of the first comparator is signally-connected to the first low potential signal; an output terminal of the first comparator is connected to an input terminal of the inverter; and an output terminal of the inverter is connected to a control terminal of the switching circuit.

3. The protection system for the GOA circuit as claimed in claim 2, wherein the low potential signal further comprises a second low potential signal; the detection circuit means further comprises a second comparator; and an input terminal of the second comparator is signally-connected to the second low potential signal; both an output terminal of the second comparator and the output terminal of the first comparator are connected to the input terminal of the inverter.

4. The protection system for the GOA circuit as claimed in claim 3, wherein the first comparator comprises:

a first TFT, a second TFT, a third TFT, and a fourth TFT, arranged in a first row;

a fifth TFT, a sixth TFT, a seventh TFT and an eighth TFT, arranged in a second row, wherein sources of the first TFT, the second TFT, the third TFT, and the fourth TFT are electrically connected to a first voltage to form a high potential circuit loop, drains of the fifth TFT, the sixth TFT, the seventh TFT and the eighth TFT are electrically connected to a second voltage to form a low potential circuit loop.

5. The protection system for the GOA circuit as claimed in claim 4, wherein the inverter comprises a ninth TFT, a tenth TFT, an eleventh TFT and a twelfth TFT; wherein a gate of the ninth TFT and a gate of the twelfth TFT are electrically connected to the output terminals of the first comparator and the second comparator, a drain of the ninth TFT is electrically connected to a drain of the twelfth ITT, and is electrically connected to a third voltage to form the low potential circuit loop; a source of the ninth TFT is electrically connected to a source of the eleventh TFT, and the source of the ninth TFT is electrically connected to a drain of the tenth TFT, a gate of the tenth TFT, a source of the tenth TFT and the source of the eleventh TFT are electrically connected to each other and the first voltage to form the high potential circuit loop.

6. The protection system for the GOA circuit as claimed in claim 5, wherein the eighth TFT to the twelfth TFT are N-type TFTs.

7. The protection system for the GOA circuit as claimed in claim 4, wherein the first TFT to the eighth TFT are N-type TFTs.

8. The protection system for the GOA circuit as claimed in claim 3, a structure and a function of the first comparator and the second comparator are identical and are used for inputting different low voltage signals of the GOA unit, and if one of the output terminals of the first comparator and the second comparator outputs a high potential voltage, the inverter outputs a low potential voltage.

9. The protection system for the GOA circuit as claimed in claim 1, wherein the switching circuit comprises a switching thin film transistor (TFT); and a drain of the switching TFT is signally-connected to the initial trigger signal; a source of the switching TFT is connected to the GOA circuit; a gate of the switching TFT is signally-connected to the driving signal.

10. The protection system for the GOA circuit as claimed in claim 9, wherein the switching TFT is an N-type TFT.

11. A liquid crystal display (LCD) panel comprising a protection system of a gate on array (GOA) circuit, the protection system comprising a detection circuit means connected to the GOA circuit, and configured to generate a driving signal in response to a low potential signal of the GOA circuit; and a switching circuit signally-connected to an initial trigger signal, and connected to the detection circuit means and the GOA circuit, the switching circuit configured to transmit the initial trigger signal to the GOA circuit according to the driving signal; wherein upon a low voltage level of the low potential signal, the switching circuit is turned on to conduct the initial trigger signal to the GOA circuit; and upon a high voltage level of the low potential signal, the switching circuit is turned off so that the GOA circuit does not conduct the initial trigger signal, the GOA circuit comprising a plurality of stages of GOA units, except fora last stage of the GOA units, an output scan signal of each stage of the GOA units serves as a cascade signal of a next stage of the GOA units; except for a first stage of the GOA units, the output scan signal of each stage of the GOA units serves as a pull-down signal of a previous stage of the GOA units, and the pull-down signal is used to correct a waveform of the scan signal at the previous stage of the GOA units.

12. The LCD panel as claimed in claim 11; wherein the detection circuit means comprises a first comparator and an inverter; the low potential signal comprises a first low potential signal; and an input terminal of the first comparator is signally-connected to the first low potential signal; an output terminal of the first comparator is connected to an input terminal of the inverter; and an output terminal of the inverter is connected to a control terminal of the switching circuit.

13. The LCD panel as claimed in claim 12, wherein the low potential signal further comprises a second low potential signal; the detection circuit means further comprises a second comparator; and an input terminal of the second comparator is signally-connected to the second low potential signal; both an output terminal of the second comparator and the output terminal of the first comparator are connected to the input terminal of the inverter.

14. The LCD panel as claimed in claim 13, wherein the first comparator comprises a first TFT, a second TFT, a third TFT, a fourth TFT, arranged in a first row; a fifth TFT, a sixth TFT, a seventh TFT and an eighth TFT, arranged in a second row; wherein sources of the first TFT, the second TFT, the third TFT and the fourth TFT are electrically connected to a first voltage to form a high potential circuit loop; drains of the fifth TFT, the sixth TFT, the seventh TFT and the eighth TFTs are electrically connected to a second voltage to form a low potential circuit loop.

15. The LCD panel as claimed in claim 14, wherein the inverter comprises a ninth TFT, a tenth TFT, an eleventh TFT, a twelfth TFT; wherein a gate of the ninth TFT and a gate of the twelfth TFT are electrically connected to the output terminals of the first comparator and the second comparator, a drain of the ninth TFT is electrically connected to a drain of the twelfth TFT, and is electrically connected to a third voltage to form the low potential circuit loop; a drain of the ninth TFT is electrically connected to a drain of the eleventh TFT, and a source of the ninth TFT is electrically connected to a drain of the tenth TFT, a gate of the tenth TFT, a source of the tenth TFT, and a source of the eleventh TFT are electrically connected to each other and 28V voltage to form the high potential circuit loop.

16. The LCD panel as claimed in claim 15, wherein the eighth TFT to the twelfth TFT are N-type TFTs.

17. The LCD panel as claimed in claim 14, wherein the first TFT to the eighth TFT are N-type TFTs.

18. The LCD panel as claimed in claim 13, wherein a structure and a function of the first comparator and the second comparator are identical and are used for inputting different low voltage signals of the GOA unit, if one of the output terminals of the first comparator and the second comparator outputs a high potential voltage, the inverter outputs a low potential voltage.

19. The LCD panel as claimed in claim 11, wherein the switching circuit comprises a switching thin film transistor (TFT); and a drain of the switching TFT is signally-connected to the initial trigger signal; a source of the switching TFT is connected to the GOA circuit; a gate of the switching TFT is signally-connected to the driving signal.

20. The LCD panel as claimed in claim 19, wherein the switching TFT is an N-type TFT.

* * * * *